US008350702B2

(12) United States Patent
Copeland et al.

(10) Patent No.: US 8,350,702 B2
(45) Date of Patent: Jan. 8, 2013

(54) COMBINATION EAS AND RFID SECURITY TAG HAVING STRUCTURE FOR ORIENTING A HYBRID ANTENNA RFID ELEMENT

(75) Inventors: Richard L. Copeland, Lake Worth, FL (US); Edward Day, Pembroke Pines, FL (US); William Johnson, III, Lake Worth, FL (US); Dan Luo, Lake Worth, FL (US); Eugenio Morgado, Royal Palm Beach, FL (US); Dale W. Raymond, Boca Raton, FL (US)

(73) Assignee: Sensormatic Electronics, LLC, Boca Raton, FL (US)

( * ) Notice: Subject to any disclaimer, the term of this patent is extended or adjusted under 35 U.S.C. 154(b) by 450 days.

(21) Appl. No.: 12/822,634

(22) Filed: Jun. 24, 2010

(65) Prior Publication Data

US 2011/0001620 A1 Jan. 6, 2011

Related U.S. Application Data

(60) Provisional application No. 61/270,024, filed on Jul. 1, 2009.

(51) Int. Cl.
*G08B 13/14* (2006.01)

(52) U.S. Cl. ..... 340/572.7

(58) Field of Classification Search ..... 340/572.7, 340/572.1–572.5, 572.8, 572.9, 10.1; 235/385
See application file for complete search history.

(56) References Cited

U.S. PATENT DOCUMENTS

| | | | | |
|---|---|---|---|---|
| 6,121,878 | A | 9/2000 | Brady | |
| 8,026,818 | B2 * | 9/2011 | Cote et al. | 340/572.7 |
| 8,056,814 | B2 * | 11/2011 | Martin et al. | 235/487 |
| 8,072,332 | B2 * | 12/2011 | Forster | 340/572.3 |
| 2007/0194927 | A1 | 8/2007 | Peter | |
| 2008/0088460 | A1 | 4/2008 | Copeland | |
| 2008/0303737 | A1 | 12/2008 | Honda et al. | |
| 2010/0141452 | A1 * | 6/2010 | Lian et al. | 340/572.3 |
| 2010/0259392 | A1 * | 10/2010 | Chamandy et al. | 340/572.8 |

FOREIGN PATENT DOCUMENTS

| | | | |
|---|---|---|---|
| KR | 2009 0003795 | A | 1/2009 |
| WO | WO 2007/092566 | A2 | 8/2007 |

OTHER PUBLICATIONS

EPO International Search Report and Written Opinion dated Oct. 1, 2010 for corresponding appln PCT/US10/01835.

* cited by examiner

*Primary Examiner* — Phung Nguyen

(74) *Attorney, Agent, or Firm* — Alan M. Weisberg; Christopher & Weisberg, P.A.

(57) ABSTRACT

A security tag including independent EAS and RFID components disposed in a housing configured for geometric placement of the RFID and EAS components for optimum RFID performance. The EAS component is situated in a first compartment and the RFID component is situated in a second compartment. The RFID component includes a hybrid antenna RFID inlay and an IC chip. The tag housing includes a key structure that minimizes the de-tuning of both the EAS and RFID components by positioning the IC chip such that the IC chip is closer to a first side of the second compartment than the second side of the second compartment when the antenna inlay is inserted within the housing. The housing further includes one or more pins that raise the RFID inlay above the magnetic resonator of the EAS component to further insure optimal RFID read performance.

20 Claims, 6 Drawing Sheets

COMBINATION EAS AND RFID SECURITY TAG HAVING STRUCTURE FOR ORIENTING A HYBRID ANTENNA RFID ELEMENT

CROSS-REFERENCE TO RELATED APPLICATION

This application is related to and claims priority to U.S. Provisional Patent Application Ser. No. 61/270,024, filed Jul. 1, 2009 entitled COMBINATION EAS AND RFID SECURITY TAG WITH MEANS FOR OPTIMAL ORIENTATION OF A HYBRID ANTENNA RFID ELEMENT, the entirety of which is incorporated herein by reference.

STATEMENT REGARDING FEDERALLY SPONSORED RESEARCH OR DEVELOPMENT n/a

FIELD OF THE INVENTION

The present invention relates generally to security tags and more specifically to a combination electrical article surveillance ("EAS")/radio frequency identification ("RFID") security tag with EAS and RFID components configured within the tag housing.

BACKGROUND OF THE INVENTION

Electronic article surveillance (EAS) systems are generally known in the art for the prevention or deterrence of unauthorized removal of articles from a controlled area. In a typical EAS system, EAS markers (known as tags or labels) are designed to interact with an electromagnetic field located at the exits of the controlled area, such as a retail store. These EAS markers are attached to the articles to be protected. If an EAS tag is brought into the electromagnetic field or "interrogation zone," the presence of the tag is detected and appropriate action is taken, such as generating an alarm. For authorized removal of the article, the EAS tag can be deactivated, removed or passed around the electromagnetic field to prevent detection by the EAS system.

EAS systems typically employ either reusable EAS tags or disposable EAS tags or labels to monitor articles to prevent shoplifting and unauthorized removal of articles from the store. The reusable EAS tags are normally removed from the articles before the customer exits the store. The disposable tags or labels are generally attached to the packaging by adhesive or are located inside the packaging. These tags typically remain with the articles and must be deactivated before they are removed from the store by the customer. Deactivation devices may use coils which are energized to generate a magnetic field of sufficient magnitude to render the EAS tag inactive. The deactivated tags are no longer responsive to the incident energy of the EAS system so that an alarm is not triggered.

Radio-frequency identification (RFID) systems are also generally known in the art and may be used for a number of applications, such as managing inventory, electronic access control, security systems, and automatic identification of cars on toll roads. An RFID system typically includes an RFID reader and an RFID device. The RFID reader may transmit a radio-frequency carrier signal to the RFID device. The RFID device may respond to the carrier signal with a data signal encoded with information stored by the RFID device.

The market need for combining EAS and RFID functions in the retail environment is rapidly emerging. Many retail stores that now have EAS for shoplifting protection rely on bar code information for inventory control. RFID offers faster and more detailed inventory control over the bar code. Retail stores already pay a considerable amount for hard tags that are re-useable. Adding RFID technology to EAS hard tags could easily pay for the added cost due to improved productivity in inventory control as well as loss prevention.

There have been attempts to incorporate both EAS and RFID capabilities within one security tag, but these attempts have been met with difficulties. One manner in which a combination EAS/RFID label (or tag) may be utilized is to put the EAS-related components together with the RFID-related components and package them together in a single housing. However, electrical or electro-mechanical interacting factors may affect the performance of either the EAS function and/or the RFID function. Placing the RFID label on top of the EAS label is the most convenient way to incorporate both components in a single housing since this saves space, but this may result in substantial de-tuning and signal loss of the RFID label. For example, in a typical RFID device, performance of the RFID label is typically very sensitive to impedance matching of an application specific integrated circuit ("ASIC")/lead frame assembly for the RFID device to the effective impedance of an RFID antenna mounted on a substrate. Other objects surrounding the RFID label may also contribute to either the effective impedance or the absorption of electromagnetic energy used to read the RFID label.

Some existing 2450 MHz EAS/RFID combination labels have used a configuration where an RFID label and an EAS label are placed in an overlapping configuration. However, this particular configuration tends to lead to considerable degradation in the RFID label detection capabilities. Other configurations place the RFID and EAS components in an end-to-end or slightly overlap arrangement. However, this results in a tag size that is prohibitively large. If the RFID and EAS components are placed in a side-by-side configuration, the result is often an irregular RFID detection pattern. Thus, designs which have been able to successfully market a combination EAS/RFID tag without degrading the performance of the RFID detection pattern are not known. Most applications using combined EAS and RFID detection of tagged items use EAS and RFID labels that are mounted separately. But by mounting the EAS and RFID components separately, the components occupy considerably more space on the tagged item.

Security tags including an EAS component in combination with an RFID component with a hybrid antenna inlay are described in Applicants' co-pending application Ser. No. 11/667,743 filed Nov. 15, 2005, application Ser. No. 11/667,742 filed Nov. 15, 2005, application Ser. No. 11/939,851 filed Nov. 14, 2007, and application Ser. No. 11/939,921 filed Nov. 14, 2007. The disclosures of these applications are herein incorporated by reference.

In the devices disclosed in application Ser. Nos. 11/939,851 and 11/939,921, the RFID component includes a hybrid antenna inlay. The hybrid antenna RFID element at least partially overlaps the EAS element and a small spacer is disposed therebetween, such as a low foam insert. The RFID element read range is affected and controlled by the spacing between the RFID element and the EAS element.

While these prior art arrangements do allow a smaller overall size of the security tag and provide acceptable RFID performance as compared with other devices, it has been discovered that placement of the RFID chip connected to the magnetic loop of the hybrid antenna adjacent to or near the EAS element results in a significant de-tuning of the RFID element.

Therefore, what is needed is a combination EAS and RFID security tag with a housing configured for optimum geometric placement of the RFID and EAS elements for improved near field and far field RFID performance as compared with existing devices.

SUMMARY OF THE INVENTION

The present invention advantageously provides a combination EAS/RFID security tag using an RFID hybrid antenna inlay and an EAS Acousto-Magnetic ("AM") element where the tag housing is arranged to minimize de-tuning of both the EAS and RFID performance and positions the RFID chip in the RFID antenna inlay such that the chip is always positioned away from the EAS elements. The tag housing also eliminates the need for a separate spacer. The RFID antenna inlay is held in position by the features of the tag housing.

In one aspect of the invention, a combination Electronic Article Surveillance (EAS)/Radio Frequency Identification (RFID) security tag is provided. The tag includes a housing having a top interior surface, a bottom interior surface opposite the top interior surface, a first compartment, and a second compartment, where each of the first compartment and the second compartment has a corresponding first longitudinal side and second longitudinal side opposite the first longitudinal side, the first longitudinal side of the first compartment being adjacent the second longitudinal side of the second compartment. An EAS component is situated within the first compartment and an RFID component is situated within the second compartment. The RFID component includes an antenna inlay having an integrated circuit, and a key structure positioning the integrated circuit such that the integrated circuit is closer to the first side of the second compartment than to the second side of the second compartment when the antenna inlay is inserted within the second component.

In another aspect of the invention, a combination Electronic Article Surveillance (EAS)/Radio Frequency Identification (RFID) security tag is provided. The tag includes a housing having a top interior surface, a bottom interior surface opposite the top interior surface, a first compartment, and a second compartment. An EAS component is situated within the first compartment, where the EAS component includes a magnetic resonator element, a bias magnet, and a spacer situated between the magnetic resonator element and the bias magnet. An RFID component is situated within the second compartment, where the RFID component is situated closer to the top interior surface than the magnetic resonator element is situated to the top interior surface.

In yet another aspect of the invention, a method of positioning an RFID antenna inlay having an integrated circuit within a housing of a combination EAS and RFID security tag is provided. The housing includes a top interior surface, a bottom interior surface opposite the top interior surface, a first compartment, and a second compartment, where each of the first compartment and the second compartment has a corresponding first longitudinal side and second longitudinal side opposite the first longitudinal side, the first longitudinal side of the first compartment being adjacent the second longitudinal side of the second compartment. The method includes positioning an EAS component within the first compartment of a housing, and positioning the antenna inlay within the second compartment of the housing such that the integrated circuit is closer to the first side of the second compartment than it is to the second side of the second compartment when the antenna inlay is inserted within the housing.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

Figure 1:
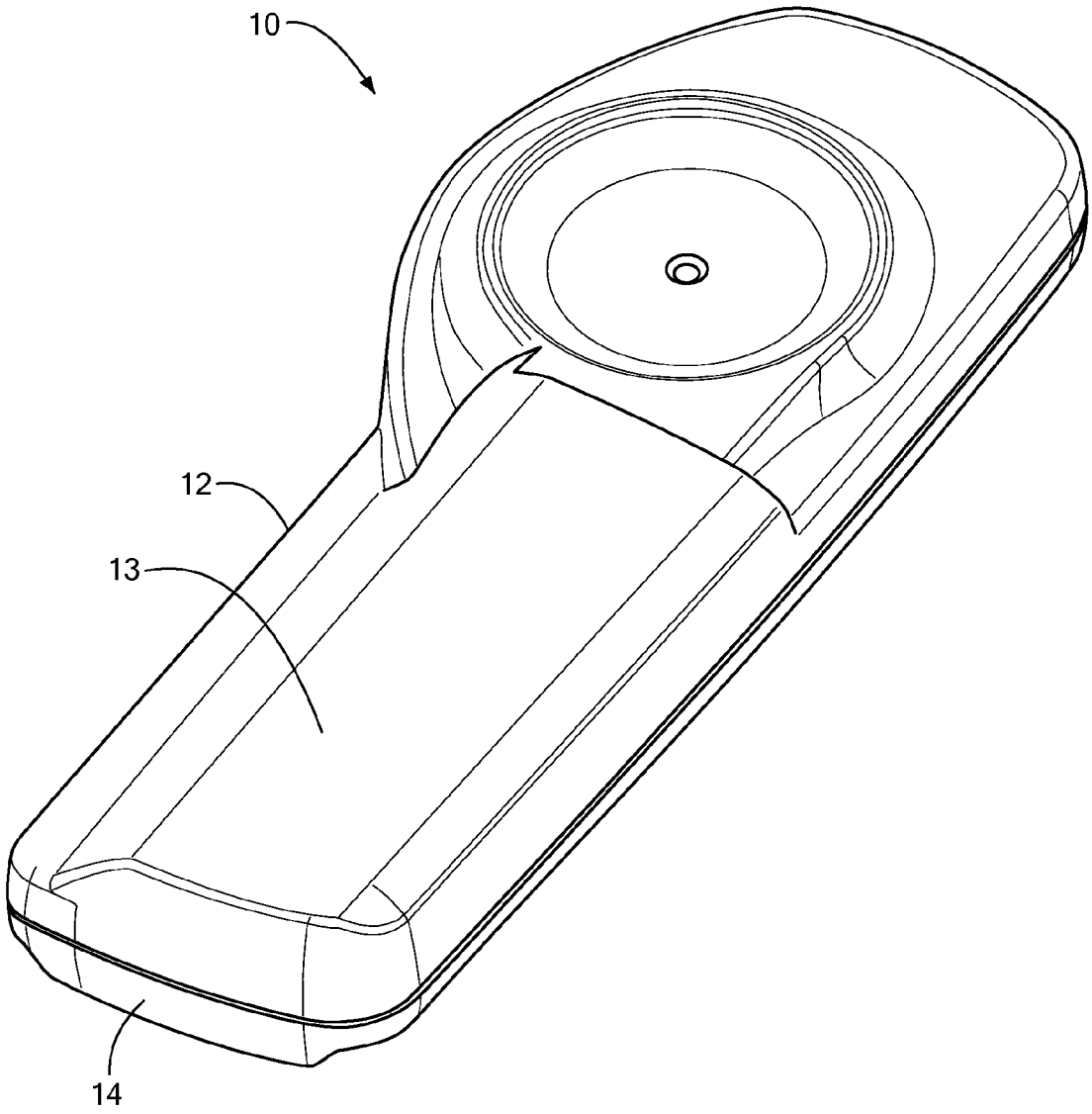
FIG. 1 is a top perspective view of a combination EAS/RFID security tag housing constructed in accordance with the principles of the present invention.

Before describing in detail exemplary embodiments that are in accordance with the present invention, it is noted that the embodiments reside primarily in combinations of apparatus components and processing steps related to implementing a security tag that includes an electronic article surveillance (EAS) component for the prevention or deterrence of unauthorized removal of articles from a controlled area in combination with a radio frequency identification (RFID) component label or tag for obtaining data specific to the article. The present disclosure relates to a combination EAS-RFID security tag in which the RFID component includes an RFID hybrid antenna inlay having both a spiral antenna and a magnetic loop antenna, and the tag housing is configured to position the EAS and RFID components to maximize RFID performance as compared with known devices.

Accordingly, the system and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

As used herein, relational terms, such as "first" and "second," "top" and "bottom," and the like, may be used solely to distinguish one entity or element from another entity or element without necessarily requiring or implying any physical or logical relationship or order between such entities or elements.

One embodiment of the present invention advantageously provides a combination EAS/RFID security tag that includes a housing configuration to allow the positioning, in a side-by-side arrangement, of the EAS and RFID components without de-tuning the RFID component. By providing a keying mechanism that includes an aperture or a notch in the RFID element at a particular location and providing a corresponding protrusion in the security tag housing, the RFID chip away will always be positioned away from the de-tuned position adjacent to the EAS elements. Additionally, the housing structure of the security tag is configured to position the RFID component away from both the top and bottom surfaces of the housing of the security tag to further minimize de-tuning of the RFID element. This housing also positions the RFID component closer toward the bottom surface of the housing since the bottom portion of the housing faces the tag detacher's top surface. The result is that the near field coupling to the detacher antenna is improved. Furthermore, the EAS and RFID components are positioned relative to a clamp release mechanism in order to minimize de-tuning of the RFID and EAS components even when the clamp is exposed to large magnetic field levels.

The security tag of the present invention provides RFID performance which is optimized in both the near and far field as compared with known devices. The far field performance is enhanced by minimizing the de-tuning effects of the EAS elements and the near field performance is enhanced by placing the RFID antenna inlay closer toward the surface of the tag that faces the detacher, where the RFID reader antenna resides. The invention is also easy to manufacture and assemble, thus reducing the manufacturing cost.

The present invention relates also to a method of positioning a hybrid antenna RFID antenna inlay within the housing of a combination EAS and RFID security tag such that the hybrid antenna RFID chip is always located away from the EAS elements. The method can include piercing the RFID component to form a notch or an aperture in the RFID component and using a mechanical housing alignment pin inserted through the aperture to secure the RFID component within the housing.

The present disclosure will be understood more fully from the detailed description given below and from the accompanying drawings of particular embodiments of the invention which, however, should not be taken to limit the invention to a specific embodiment but are for explanatory purposes.

Numerous specific details may be set forth herein to provide a thorough understanding of a number of possible embodiments of a combination EAS/RFID tag incorporating the present disclosure. It will be understood by those skilled in the art, however, that the embodiments may be practiced without these specific details. In other instances, well-known methods, procedures, components and circuits have not been described in detail so as not to obscure the embodiments. It can be appreciated that the specific structural and functional details disclosed herein may be representative and do not necessarily limit the scope of the embodiments.

Referring now to the drawing figures in which like reference designators refer to like elements, there is shown in FIG. 1 an exemplary configuration of a combination EAS/RFID security tag 10 according to an embodiment of the present invention. Security tag 10 includes a plastic housing 12 which is configured to contain the EAS and RFID components therein, as shown in the illustration of the lower portion of the disassembled tag 10 depicted in FIG. 2. Housing 12 includes a top section 13 and a bottom section 14.

Figure 2:
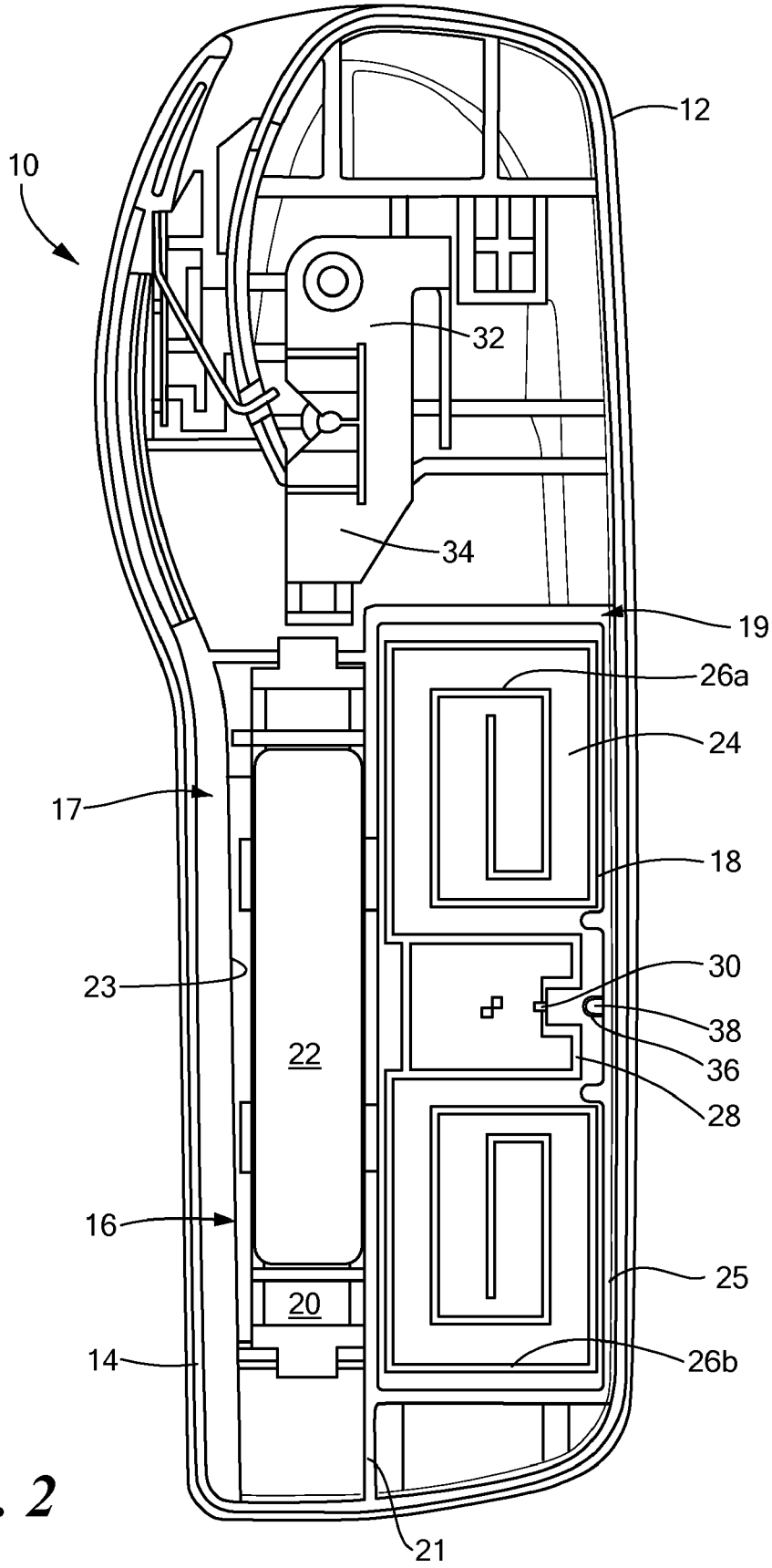
FIG. 2 is a top view of the bottom portion of the security tag of FIG. 1 showing the components disposed therein.

Referring now to FIG. 2, bottom section 14 of tag 10 is shown. Tag 10 can include a plurality of chambers to house various components. EAS component 16 is located along the long side of an RFID component 18. In one embodiment, EAS component 16 resides within a first chamber (not shown) and RFID component 18 resides in a separate chamber (not shown). However, regardless of whether these two components are in a separate chamber or not, EAS component 16 and RFID component 18 maintain a side-by-side relationship with each other. EAS component 16 is an EAS label or tag which may include, for example, but is not limited to, a magnetic resonator element (not shown) situated below a housing spacer 20 made of plastic or some other material, which is situated below a bias magnet 22 (or other EAS type resonant circuits). Other EAS elements not specifically disclosed herein may perform the function of EAS component 16.

Alongside the EAS component 16 is RFID component 18. RFID component 18 may include, for example, a semiconductor integrated circuit 30 and a tunable antenna. The tunable antenna, such as antenna inlay 24 shown in FIG. 2, may be tuned to a desired operating frequency by adjusting the length of the antenna. The range of operating frequencies may vary, although the embodiments may be particularly useful for ultra-high frequency (UHF) spectrum. Depending upon the application and the size of the area available for the antenna 24, the antenna 24 may be tuned within several hundred Megahertz (MHz) or higher, such as 868-950 MHz, for example. In one embodiment, for example, the tunable antenna 24 may be tuned to operate within an RFID operating frequency, such as the 868 MHz band used in Europe, the 915 MHz Industrial, Scientific and Medical (ISM) band used in the United States, and the 950 MHz band proposed for Japan. It is again noted that these operating frequencies are given by way of example only, and the embodiments are not limited in this context.

RFID component 18 may also be a RFID security tag which includes memory to store RFID information and which communicates the stored information in response to an interrogation signal transmitted by an RFID reader. RFID information may include any type of information capable of being stored in a memory used by RFID component 18. Examples of RFID information include a unique tag identifier, a unique system identifier, an identifier for the monitored object, and so forth. The types and amount of RFID information are not limited in this context.

RFID component 18 may also be a passive RFID security tag. A passive RFID security tag does not use an external power source, but rather uses the energy in interrogation signals as a power source. RFID component 18 may be activated by a direct current voltage that is developed as a result of rectifying the incoming RF carrier signal including interrogation signals. Once the RFID components activated, it may then transmit the information stored in its memory register via response signals.

Figure 3:
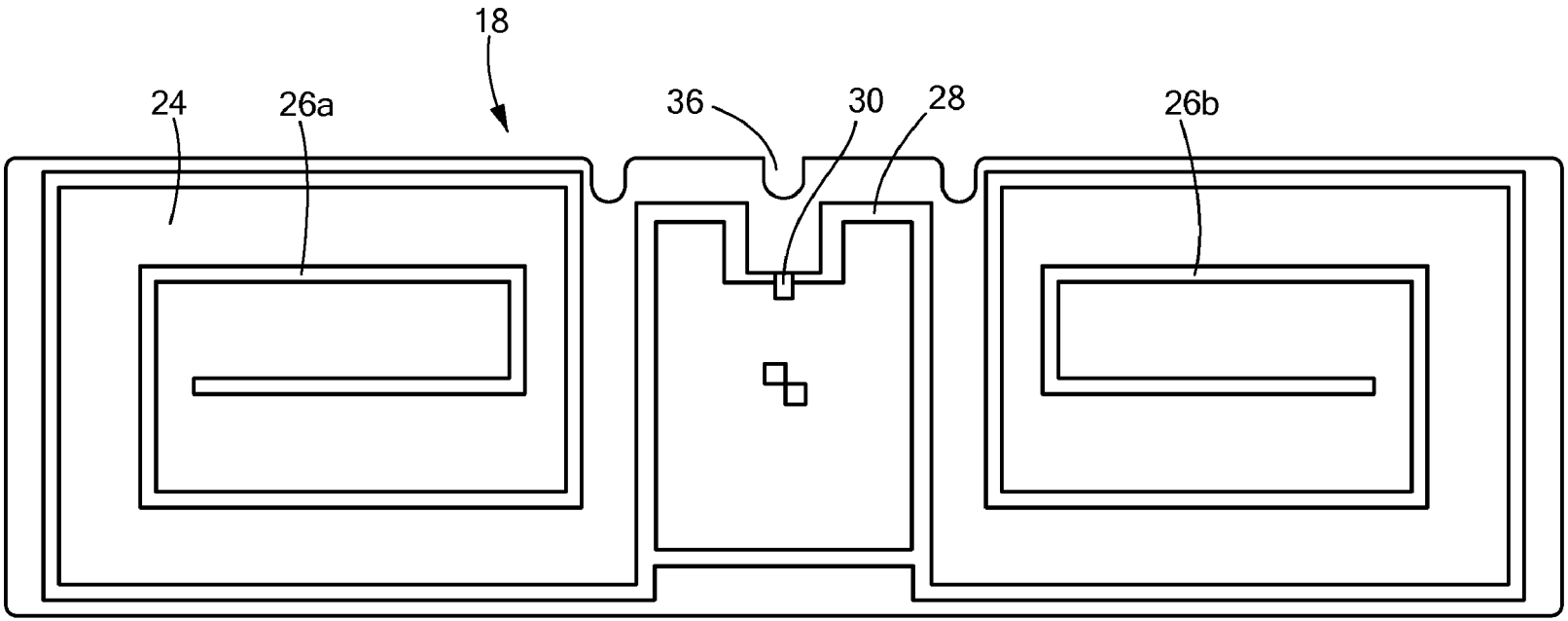
FIG. 3 illustrates an exemplary RFID hybrid antenna inlay used in the combination EAS/RFID security tag of the present invention.

In one embodiment, RFID component 18 is an RFID label or tag and includes a hybrid antenna inlay 24 having a pair of inward spiral antennas 26*a* and 26*b* (collectively "26"), a magnetic loop antenna 28 situated between and in electrical contact with spiral antennas 26*a* and 26*b*, and an integrated circuit 30 in electrical contact with magnetic loop antenna 28. The hybrid antenna inlay design of the present disclosure maintains the far field response abilities of the spiral antenna 26 while increasing the near field magnetic performance due to magnetic loop antenna 28. A detailed view of the hybrid antenna inlay is shown in FIG. 3 and is discussed in greater detail below.

Referring again to FIG. 2, tag 10 includes an attachment clamp 32 which is located at the forward end of tag 10 opposite RFID component 18 and EAS component 16. Attachment clamp 32 is typically metal and cooperates with an attachment element, such as a pin, to attach security tag 10 to an item to be secured (e.g. an article of clothing). Advantageously, attachment clamp 32 is situated at least a predetermined distance away from both the EAS component 16 and the RFID component and includes an extended portion 34 to further provide a "buffer", that separates clamp 32 from EAS component 16 and RFID component 18. The location of clamp 32 within housing 12 and the distance it is situated away from EAS component 16 and RFID component 18 minimizes de-tuning of the RFID component 18 and EAS component 16 even when clamp 32 is exposed to large magnetic field levels.

RFID antenna inlay 24 and housing 12 include a location key structure in order to ensure that the RFID integrated circuit 30 is located away from the elements of EAS component 16 when RFID component 18 is inserted within housing 12. In one embodiment, the location key structure includes an aperture or a notch 36 (best seen in FIG. 3) formed in RFID antenna inlay 24, which cooperates with a corresponding protruding alignment flange 38 located in the interior bottom surface of housing 12. "Bottom surface" or "bottom interior surface" as defined herein shall mean any surface within the interior of bottom section 14. Thus, flange 38 might be located at the actual bottom interior surface of bottom section 14 or may be located along the side walls of the interior of bottom section 14. By placing a punched hole or notch in the RFID component 18 at a particular location and providing a mechanical key structure in the security tag housing 12 and RFID antenna inlay 24, the RFID integrated circuit 30 can advantageously be fixed in a position within housing 12 away from the position adjacent to the elements of EAS component 16 which may de-tune the integrated circuit 30. The key structure may include other mating arrangements that situate antenna inlay 24 such that integrated circuit 30 is positioned away from EAS component 16.

Therefore, in one embodiment, housing 12 includes a first compartment 17 and a second compartment 19, where EAS component 16 is situated within first compartment 17 and RFID component 18 is situated within second compartment 19. As seen in FIG. 2, first compartment 17 includes a first longitudinal side 21 an opposing second longitudinal side 23. Second compartment 19 also includes a first longitudinal side 25 and a second longitudinal side 21, where the first longitudinal side 21 of first compartment 17 is the same as the second longitudinal side 21 of the second compartment 19 since they share a common wall. In other embodiments, each compartment will include separate walls to house their corresponding components. As seen in FIG. 2, the key structure described above is operable to position the integrated circuit 30 such that integrated circuit 30 is closer to first longitudinal side 25 of second compartment 19 than it is to the second longitudinal side 21 of second compartment 19 when antenna inlay 24 is inserted within the housing 12.

Thus, when RFID component 18 is inserted within housing 12, it can only be inserted one way, i.e., in the orientation where integrated circuit 30 is situated away from EAS component 16, i.e., closer to the side of antenna inlay 24 that is furthest from EAS element 16, due to the mating of flange 38 within notch 36. This orientation allows the RFID antenna inlay 24 to fit snugly within housing 12 or within a chamber in housing 12 and upon one or more support pins (shown in FIG. 4). Trying to insert RFID component 18 within housing 12 with RFID antenna inlay 24 facing in the opposite direction, i.e., with integrated circuit 30 along side EAS component 16, would result in an improper fit due to flange 38 forcing RFID antenna inlay 24 upwards and out of its alignment within housing 12 and not allowing the top cover of housing 12 to properly mate with bottom section 14. Therefore, the present invention advantageously insures the proper placement of RFID component 18 within housing 12 situating integrated circuit away from EAS component 16 thus minimize potential de-tuning of integrated circuit 30 due to the effects of the elements of EAS component 16.

FIG. 3 illustrates one embodiment of RFID antenna inlay 24, having two inward spiral antennas 26*a* and 26*b*, as well as a rectangular magnetic loop antenna 28 coupled to the inward spiral antennas 26*a* and 26*b*. Although there may be a slight frequency shift, the insertion of RFID antenna inlay 24 within housing 12 does not affect the relative sensitivity of the RFID component 18 and has minimal power loss. Thus, the design of housing 12 and the relative positioning of EAS component 16 and RFID component 18 have relatively little effect on the overall RFID performance of tag 10. Integrated circuit 30 is electrically connected to magnetic loop antenna 28 and magnetic loop antenna 28 is then electrically connected to the inward spiral antennas 26*a* and 26*b* as shown in FIG. 3. The overall geometry of magnetic loop antenna 28 is such that the near field magnetic H performance is optimized. Spiral antennas 26*a* and 26*b* dominate the far field response.

Magnetic loop antenna 28 also acts to reduce electrostatic discharge ("ESD") damage to integrated circuit 30 by diverting current away from the integrated circuit 30. For low frequency or static electric E fields produced by manufacturing processes or ultrasonic welding of housing 12, the magnetic loop antenna 28 is essentially a short circuit across integrated circuit 30. If an electrical discharge initiates from one end of spiral antenna 26*a* to the end of spiral antenna 26*b*, or vice versa, loop antenna 28 diverts the discharge current away from integrated circuit 30.

Physically, the spiral antennas 26*a* and 26*b* are connected to magnetic loop antenna 28 and not directly to integrated circuit 30. When an E field is applied along the length of RFID antenna inlay 24 shown in FIG. 3, the current starts at the end of spiral antenna 26*a* (the left spiral in FIG. 3) at low levels and gradually increases to the connection point of the magnetic loop antenna 28. This current sense is counterclockwise. The current through magnetic loop antenna 28 is also of a counterclockwise sense but at much larger values. The current from the magnetic loop connection point to the right side spiral antenna 26*b* is of a counterclockwise sense and gradually decreases toward the end of this antenna trace. Thus, the direction of the currents in each spiral antenna 26*a* and 26*b* are the same.

RFID antenna inlay 24 shown in FIG. 3 is then placed inside of housing 12 of the combination EAS/RFID security tag 10, which also contains EAS component 16 and attachment clamp mechanism 32. The EAS/RFID security tag 10 utilizing the hybrid antenna inlay 24 of FIG. 3 can be read by a conventional RFID reader.

An example of a near field reader magnetic H field loop antenna used with the present invention is a 2 cm. diameter circular loop using a step-down transformer at the feed end of the loop, two tuning capacitors at the halfway point, and a terminating resistor at the opposite end of the loop. However, the invention is not limited to a particular diameter or type of near field reader magnetic loop antenna. Near field magnetic loop antenna 28 may also include a cylindrical slug of ferrite material.

Housing 12, which may be made of a plastic material, is configured to maintain RFID component 18 in a position within housing 12 so that it does not contact the top or bottom inside surfaces of security tag 10 in order to further minimize the possibility of de-tuning the RFID component 18. In one embodiment, housing 12 is configured to position RFID component 18 closer to the bottom surface of housing 12 than to the top surface of housing 12. As used herein, "bottom surface" and "bottom portion" refer to the solid portion of housing 12 and "top surface" and "top portion" refer to the portion of the housing 12 having the opening through which the locking pin is inserted for mating with clamp 32. By positioning RFID component 18 closer to the bottom surface of tag 10, which faces the top surface of a tag detacher device, the near field coupling to the detacher antenna is improved over other arrangements.

Figure 4:
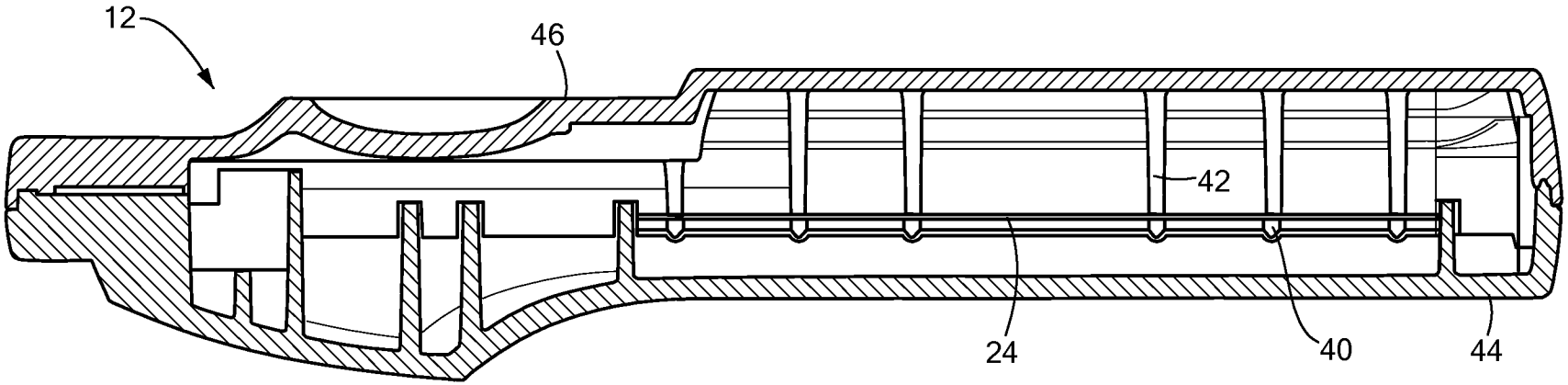
FIG. 4 is a section view of the security tag of FIG. 1 showing the RFID antenna inlay and supporting elements of the housing interior.
Figure 5:
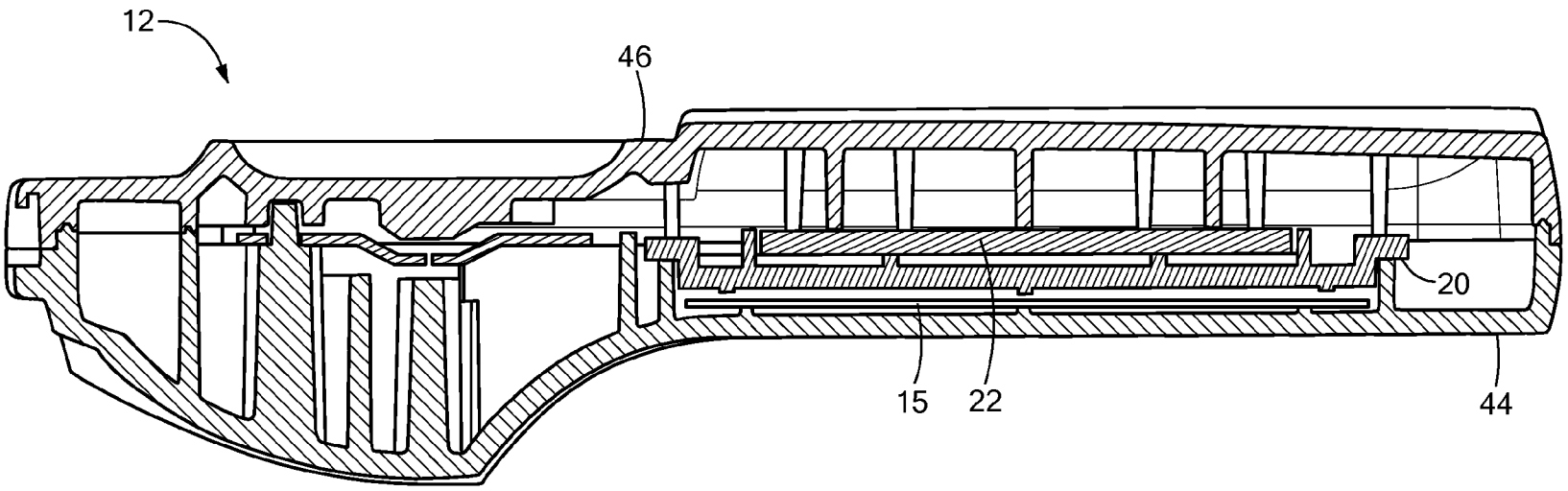
FIG. 5 is another section view of the security tag of FIG. 1 showing the EAS bias magnet and magnetic resonator elements.

FIGS. 4 and 5 show how tag housing 12 supports EAS component 16 and RFID component 18 so that no separate spacer part is required for the RFID component 18. RFID antenna inlay 24 is located away from the top and bottom inner surfaces of housing 12, but, in one embodiment, is closer to the bottom surface of housing 12, which faces the detacher. Referring specifically to FIG. 4, RFID antenna inlay 24 can be seen within housing 12. RFID antenna inlay 24 is supported by one or more support lower protrusions 40. Lower protrusions 40 extend upwards from the bottom surface of housing 12 and support RFID antenna inlay 24 which rests thereon. Lower protrusions 40 serve to assure that RFID antenna inlay 24 does not contact the bottom portion 44 of housing 12 in order to further minimize the possibility of de-tuning the RFID component 18.

As is shown in FIG. 4, in addition to being supported by lower protrusions 40, RFID antenna inlay 24 is also positioned beneath upper protrusions 42. Upper protrusions 42 serve to position RFID antenna inlay 24 away from the upper portion 46 of housing 12 to minimize the possibility of detuning the RFID component 18 and to secure RFID antenna inlay 24 within housing 12. In this embodiment, upper protrusions 42 are longer than lower protrusions 40, which results in RFID antenna inlay 24 being positioned closer to the lower part of housing 12, i.e., closer to the bottom portion 44 of housing 12 than the top portion 46 of housing 40. As discussed above, this advantageously positions RFID component 18 closer to the tag detacher's top surface when the tag detacher is used to remove the article from the tag 10.

FIG. 5, like FIG. 4, shows a section view of the housing 12 of tag 10. While FIG. 4 showed the RFID component 18, i.e., RFID antenna inlay 24, FIG. 5 illustrates the EAS component 16 of tag 10. The elements of EAS component 16, magnetic resonator element 15, spacer 20 and bias magnet 22, can be seen. These components are not supported by lower projections 40. Lower projections 40 only support RFID component 18 and, in one embodiment, lower projections 40 are situated only in second compartment 19 that houses RFID antenna inlay 24. From the view shown in FIG. 5, RFID antenna inlay 24 cannot be seen. However, RFID antenna inlay 24, supported by lower protrusions 42, resides in housing 12 such that it is substantially co-planar with bias magnet 22 and situated above magnetic resonator element 15. This arrangement provides minimizes the loading effect on the RFID signal and provides tag 10 with optimal read performance.

Figure 6:
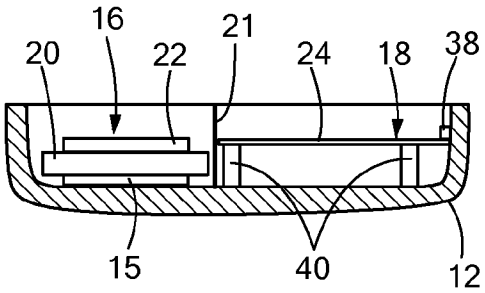
FIG. 6 is an elevation view from the bottom to the top of the security tag of FIG. 1 showing the planar relationship between the RFID component and the EAS component within the housing of the security tag of FIG. 1.

FIG. 6 illustrates a cut-away illustration of housing 12, viewed from the end of tag 10 looking towards the top of tag 10. In this view, the planar relationship between RFID component 18 and EAS component 16 can readily be seen. EAS component 16 includes magnetic resonator element 15, upon which is situated spacer 20, upon which is situated bias magnet 22. Bias magnet 22 is situated within housing 12 such that it is at substantially the same height as antenna inlay 24 of RFID component 18. Antenna inlay 24 is situated within housing 12 such that it is higher, i.e., closer to the top surface of housing 12, than spacer 20 and higher than magnetic resonator element 15.

Figure 7:
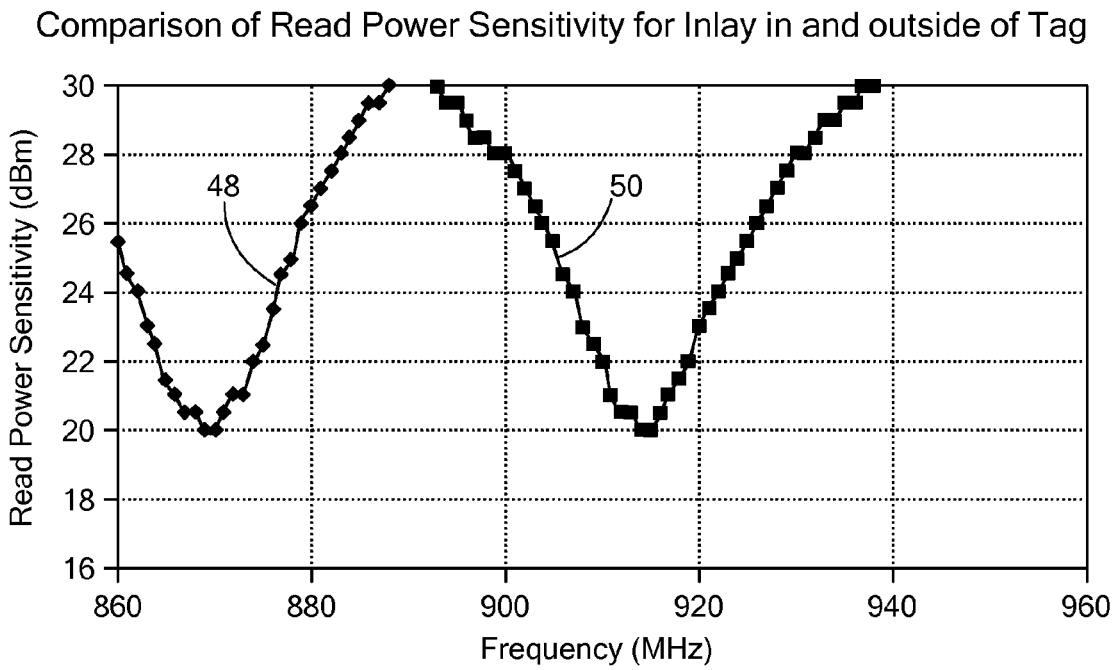
FIG. 7 is a graph representing the power with respect to frequency of an RFID antenna inlay used in the present invention measured within a tag and measured outside of the tag.

FIG. 7 represents a graph illustrating a comparison of the read power sensitivity for RFID antenna inlay 24 tuned, for example, for 868 MHz, both inside the housing 12 of tag 10, represented by graph 48, and outside of tag 10, represented by graph 50. Although the frequency is shifted, the power sensitivity remains about the same. Thus, the housing 12 and other components of tag 10 such as EAS element 16, does not impact the power sensitivity from RFID antenna inlay 24.

While certain features of the embodiments have been illustrated as described herein, many modifications, substitutions, changes and equivalents will now occur to those skilled in the art. It is therefore to be understood that the appended claims are intended to cover all such modifications and changes as fall within the true spirit of the embodiments.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

In addition, unless mention was made above to the contrary, it should be noted that all of the accompanying drawings are not to scale. Significantly, this invention can be embodied in other specific forms without departing from the spirit or essential attributes thereof, and accordingly, reference should be had to the following claims, rather than to the foregoing specification, as indicating the scope of the invention.

What is claimed is:

1. A combination Electronic Article Surveillance (EAS)/Radio Frequency Identification (RFID) security tag, comprising:

a housing having:

a top interior surface;

a bottom interior surface opposite the top interior surface;

a first compartment; and a second compartment, each of the first compartment and the second compartment having a corresponding first longitudinal side and second longitudinal side opposite the first longitudinal side, the first longitudinal side of the first compartment being adjacent the second longitudinal side of the second compartment;

an EAS component situated within the first compartment; and an RFID component situated within the second compartment, the RFID component comprising:

an antenna inlay having an integrated circuit; and a key structure positioning the integrated circuit such that the integrated circuit is closer to the first side of the second compartment than to the second side of the second compartment when the antenna inlay is inserted within the second component.

2. The combination EAS/RFID security tag of claim 1, wherein the key structure comprises a notch in the antenna inlay and a flange on the bottom interior surface of the housing such that the flange mates with the notch when the antenna inlay is inserted within the housing.

3. The combination EAS/RFID security tag of claim 1, the antenna inlay further comprising an inward spiral antenna and a magnetic loop antenna in electrical contact with the loop antenna, the spiral antenna having a first section and a second section, wherein the magnetic loop antenna is positioned between the first section and the second section of the spiral antenna.

4. The combination EAS/RFID security tag of claim 1, wherein the housing further comprises one or more pins located on the top interior surface and the bottom interior surface to prohibit the RFID component from contacting the top interior surface and the bottom interior surface of the housing.

5. The combination EAS/RFID security tag of claim 4, wherein the one or more pins located on the top interior surface are longer than the one or more pins located on the bottom interior surface thereby positioning the RFID component closer to the bottom interior surface than to the top interior surface.

6. The combination EAS/RFID security tag of claim 1, further comprising an attachment clamp within the housing for cooperation with an attachment element to attach the security tag to an item.

7. The combination EAS/RFID security tag of claim 1, wherein the key structure is arranged to prevent insertion of the RFID component within the housing that would result in the integrated circuit being adjacent the EAS component.

8. A combination Electronic Article Surveillance (EAS)/Radio Frequency Identification (RFID) security tag comprising:

a housing having:
- a top interior surface;
- a bottom interior surface opposite the top interior surface;
- a first compartment; and
- a second compartment;

an EAS component situated within the first compartment, the EAS component comprising:
- a magnetic resonator element;
- a bias magnet; and
- a spacer situated between the magnetic resonator element and the bias magnet; and an RFID component situated within the second compartment, the RFID component situated closer to the top interior surface than the magnetic resonator element is situated to the top interior surface.

9. The combination EAS/RFID security tag of claim 8, wherein the RFID component is substantially co-planar with the bias magnet.

10. The combination EAS/RFID security tag of claim 8, wherein the RFID component comprises:

an antenna inlay comprising:
- an inward spiral antenna;
- a magnetic loop antenna in electrical contact with the spiral antenna; and
- an integrated circuit in electrical contact with the loop antenna, the antenna inlay being substantially co-planar with the bias magnet and situated closer to the top interior surface than the magnetic resonator element is situated to the top interior surface.

11. The combination EAS/RFID security tag of claim 10, wherein each of the first compartment and the second compartment having a corresponding first longitudinal side and second longitudinal side opposite the first longitudinal side, the first longitudinal side of the first compartment being adjacent the second longitudinal side of the second compartment.

12. The combination EAS/RFID security tag of claim 11, wherein the RFID component further comprises a key structure positioning the integrated circuit such that the integrated circuit is closer to the first side of the second compartment than to the second side of the second compartment when the antenna inlay is inserted within the second compartment.

13. The combination EAS/RFID security tag of claim 12, wherein the key structure comprises a notch in the antenna inlay and a flange on the bottom interior surface of the housing such that the flange mates with the notch when the antenna inlay is inserted within the housing.

14. The combination EAS/RFID security tag of claim 10, the spiral antenna having a first section and a second section, wherein the magnetic loop antenna is positioned between the first section and the second section of the spiral antenna.

15. The combination EAS/RFID security tag of claim 8, wherein the housing further comprises one or more pins located on the top interior surface and the bottom interior surface to prohibit the RFID component from contacting the top interior surface and the bottom interior surface of the housing.

16. The combination EAS/RFID security tag of claim 15, wherein the one or more pins located on the bottom interior surface of the housing are situated in the second compartment thereby positioning the RFID component closer to the top interior surface than the magnetic resonator element is positioned to the top interior surface.

17. The combination EAS/RFID security tag of claim 15, wherein the one or more pins located on the top interior surface are longer than the one or more pins located on the bottom interior surface thereby positioning the RFID component closer to the bottom interior surface than to the top interior surface.

18. The combination EAS/RFID security tag of claim 8, further comprising an attachment clamp within the housing for cooperation with an attachment element to attach the security tag to an item.

19. A method of positioning an RFID antenna inlay having an integrated circuit within a housing of a combination EAS and RFID security tag, the housing including a top interior surface, a bottom interior surface opposite the top interior surface, a first compartment, and a second compartment, each of the first compartment and the second compartment having a corresponding first longitudinal side and second longitudinal side opposite the first longitudinal side, the first longitudinal side of the first compartment being adjacent the second longitudinal side of the second compartment, the method comprising:

positioning an EAS component within the first compartment of a housing; and positioning the antenna inlay within the second compartment of the housing such that the integrated circuit is closer to the first side of the second compartment than it is to the second side of the second compartment when the antenna inlay is inserted within the housing.

20. The method of claim 19, wherein the antenna inlay further includes a notch and the bottom interior surface of the housing includes a flange, and wherein positioning the antenna inlay within the second compartment of the housing such that the integrated circuit is closer to the first side of the second compartment than it is to the second side of the second compartment when the antenna inlay is inserted within the housing includes mating the flange with the notch when the antenna inlay is inserted within the housing.

* * * * *